US006113408A

United States Patent [19]

Burwell et al.

[11] Patent Number: 6,113,408

[45] Date of Patent: Sep. 5, 2000

[54] NON-ARCING FLUORESCENT LAMP HOLDER

[75] Inventors: John W. Burwell, Rome City; Paul Littrell, Fort Wayne; James M. Gust, Wolcottville; Robert E. Bolen, Kendallville, all of Ind.

[73] Assignee: Lyall Assemblies, Inc., Albion, Ind.

[21] Appl. No.: 09/176,682

[22] Filed: Oct. 21, 1998

[51] Int. Cl.[7] ..... H01R 33/08; H01R 29/00

[52] U.S. Cl. ..... 439/226; 439/168

[58] Field of Search ..... 439/226, 168, 439/182, 220, 236, 242

[56] References Cited

U.S. PATENT DOCUMENTS 3,701,081 10/1972 Jayne et al. ..... 339/53

4,275,325 6/1981 Guim ..... 313/51

4,352,539 10/1982 Vest ..... 339/154 L 4,906,891 3/1990 Takagi et al. ..... 313/318

*Primary Examiner*—Lincoln Donovan

*Assistant Examiner*—Chandrika Prasad

*Attorney, Agent, or Firm*—Taylor & Aust, P.C.

[57] ABSTRACT

A fluorescent lamp holder assembly is adapted to receive various injection molded end cap structures allowing the fluorescent lamp holder assembly to have several embodiments, including watertight embodiments. The fluorescent lamp holder assembly may be disposable or may allow replacement of the fluorescent lamp, with the replacement style being watertight. The fluorescent lamp holder assembly generally includes a fluorescent lamp surrounded by a protective sleeve. A first end cap covers a first end of the lamp and sleeve, while a second end cap structure comprising a power connector cap and tube power connector cap covers a second end of the lamp and sleeve.

9 Claims, 2 Drawing Sheets

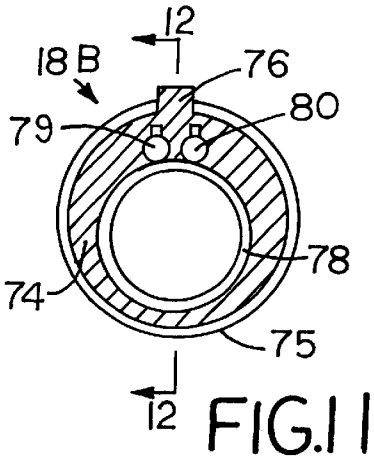
FIG.11
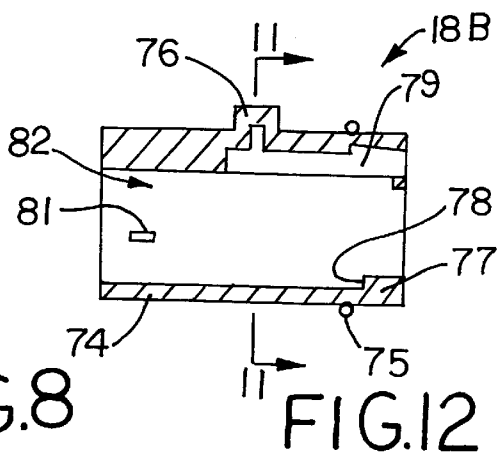
FIG.12
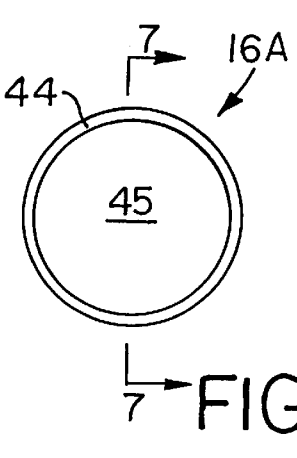
FIG.8
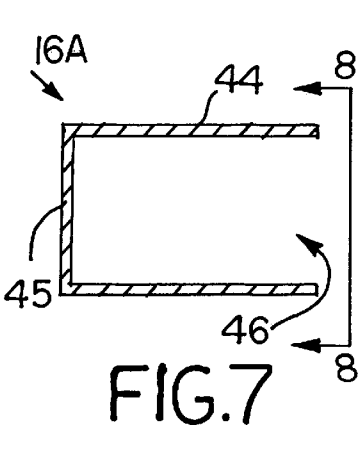
FIG.7
FIG.13
FIG.14
FIG.9
FIG.10

NON-ARCING FLUORESCENT LAMP HOLDER

BACKGROUND OF THE INVENTION

1. Field of the Invention

The present invention relates to lamp sockets, and, more particularly, to fluorescent lamp sockets.

2. Description of the Related Art

Fluorescent lamps, as known, include a glass tube coated on the inside with phosphor powders which fluoresce when excited by ultraviolet light. The glass tube is filled with rare gases (such as argon, neon, and krypton) and a small amount of mercury, and operates at a relatively low pressure. Electrodes are mounted within the glass tube and emit electrons during operation. The electrons are accelerated by the voltage across the tube until they collide with mercury atoms, causing the mercury atoms to be ionized and excited. When the mercury atoms return to their normal state, photons corresponding to mercury spectral lines in both the visible and ultraviolet region are generated, thereby exciting the phosphor coating on the inside of the tube to luminance.

To start a fluorescent lamp, electron emission from the electrodes may be induced in one of two ways. First, a filament electrode may be heated by passing current therethrough. Secondly, a high voltage which is sufficient to start an electric discharge in the lamp may be applied across the lamp without preheating the electrodes. Instant start circuits which are commonly used today typically employ the latter method of inducing electron emission from the electrodes. Instant start circuits use a ballast which applies a high voltage (e.g., up to 848 VAC) at a high frequency. Such instant start ballasts are much more energy efficient than older style ballasts which heat the electrodes.

Such fluorescent tubes come in a variety of styles and thus are used in a variety of applications. One such application is in commercial refrigeration illumination. Generally, a fluorescent lamp holder or assembly for such applications includes a fluorescent lamp surrounded by a protective plastic tube that are both retained on each end by a cap structure. One cap structure covers terminals on one end of the fluorescent lamp and the connection wires. The other cap structure couples the terminals of the other end of the fluorescent lamp to electrical power, generally by a power cord. Wires run the length of the protective plastic tube for appropriate connection to the terminals on the other end of the fluorescent lamp. Each cap structure is retained to the protective plastic tube by metal clips. The lamp assembly is generally retained within the refrigerator or freezer by clips. The power cord from the lamp assembly is wired into the power of the refrigerator. The above fluorescent lamp holder is, by its nature, disposable and not waterproof. Replacement of the fluorescent tube in the prior art holders is usually not recommended except by a skilled technician. Further, when the fluorescent lamp goes out, the entire holder must be unwired.

What is needed in the art is a fluorescent lamp holder which prevents electrical arcing between a conductor of the lamp holder and the contact pins of a fluorescent lamp.

What is also needed in the art is a fluorescent lamp holder that is waterproof for use in a moisture-laden environment.

Further needed in the art is a fluorescent lamp holder that allows replacement of the fluorescent lamp by any unskilled user.

SUMMARY OF THE INVENTION

The present invention provides a fluorescent lamp holder assembly adapted to accept various end cap structures.

In one form thereof, the fluorescent lamp holder is disposable. A protective sleeve surrounds the fluorescent lamp. A first end cap structure receives the fluorescent tube and protective sleeve and covers the wire connections to one set of terminals of the fluorescent tube. Preferably, the first end cap is permanently attached to the protective sleeve. A second end cap structure receives the other end of the protective sleeve and the fluorescent tube and includes a power attachment cap portion and a tube power connector cap portion. The power attachment cap portion receives one set of terminals of the fluorescent lamp and provides electrical coupling between the two sets of terminals of the fluorescent lamp with a source of electrical energy and is attached to the sleeve via an attachment clip. The tube power connector cap portion couples to the power attachment cap portion and provides a holder for the fluorescent tube and a pathway for the electrical wires for the second set of terminals. Preferably, the tube power connection cap portion is permanently attached to the protective sleeve.

In another form thereof, the fluorescent lamp holder provides replacement of the fluorescent tube. A first end cap structure includes terminal receptacles for receipt of one set of fluorescent lamp terminals. The receptacles are in communication with power wires of the holder and is preferably permanently attached to the protective sleeve. A second end cap structure includes a tube power attachment cap portion and a power attachment cap portion. The power attachment cap portion receives one set of terminals of the fluorescent lamp and provides electrical coupling between the two sets of terminals of the fluorescent lamp with a source of electrical energy. The tube power connector cap portion couples to the power attachment cap portion and provides a holder for the fluorescent tube and a pathway for the electrical wires for the second set of terminals. Preferably, the tube power connection cap portion is permanently attached to the protective sleeve.

It is an advantage of the present invention that various types of end cap structures may be used to provide various lamp assembly characteristics.

It is another advantage of the present invention that the lamp holder can be waterproof.

It is yet another advantage of the present invention that the lamp holder can be made disposable or replaceable.

It is another advantage of the present invention that various parts are injection molded, providing in one embodiment a watertight construction.

It is further an advantage of the present invention that one embodiment allows replacement of the fluorescent lamp to eliminate waste and the inconvenience of removing an old lamp holder and installing a new lamp holder.

It is still further an advantage of the present invention that it is usable with a variety of fluorescent tube styles with different pin configurations.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein:

FIG. 7 is a cross-sectional side view of one embodiment of an end cap as taken along line 7—7 of FIG. 8;

FIG. 8 is a front view of the end cap of FIG. 7 taken along line 8—8 thereof;

FIG. 9 is a front view of one embodiment of a tube power connector cap as taken along line 9—9 of FIG. 10;

FIG. 10 is a cross-sectional side view of the tube power connector cap of FIG. 9 taken along line 10—10 thereof;

FIG. 11 is a front view of another embodiment of a tube power connector cap as taken along line 11—11 of FIG. 12;

FIG. 12 is a cross-sectional side view of the tube power connector cap of FIG. 11 taken along line 12—12 thereof;

FIG. 13 is a front view of another embodiment of the end cap as taken along line 13—13 of FIG. 14; and FIG. 14 is a cross-sectional side view of the end cap of FIG. 13 taken along line 14—14 thereof.

Corresponding reference characters indicate corresponding parts throughout the several views. The exemplifications set out herein illustrate preferred embodiments of the invention, and such exemplifications are not to be construed as limiting the scope of the invention in any manner.

DETAILED DESCRIPTION OF THE INVENTION

Figures 1, 1A, 2, 3, 4, 5, 6:
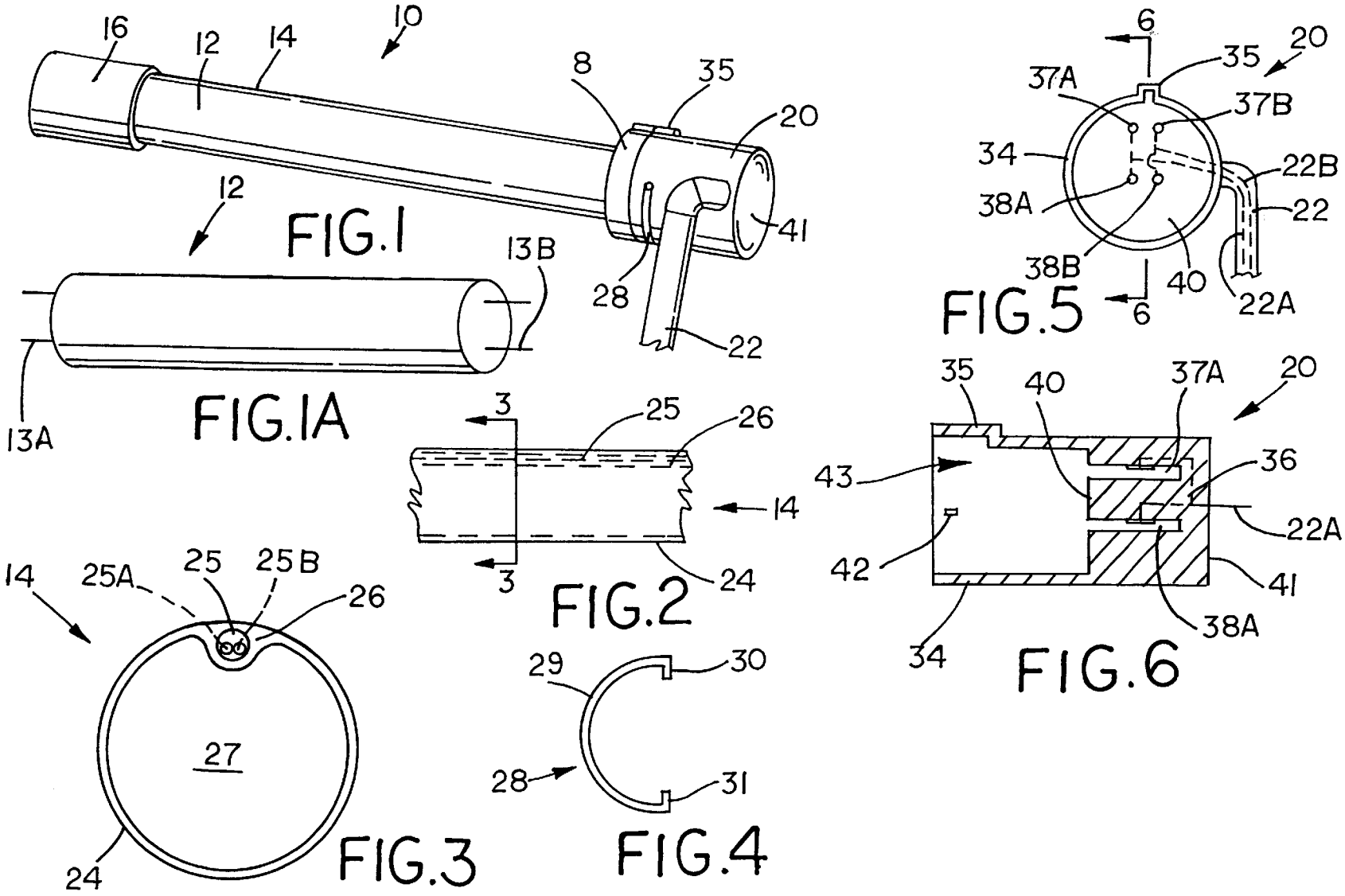
FIG. 1 is a perspective view of a generic embodiment of the present fluorescent tube holder.
FIG. 1*a* is a perspective view of a typical fluorescent tube to be held by the present fluresenttube holder.
FIG. 2 is a partial side view of the outer tube of the present fluorescent tube holder.
FIG. 3 is a sectional view along line 3—3 of FIG. 2.
FIG. 4 is a side view of an attachment clip used in the present fluorescent tube holder.
FIG. 5 is a front view of the power coupling end cap of the present invention.
FIG. 6 is a cross-sectional side view of the power coupling end cap as taken along line 6—6 of FIG. 5.

Referring now to FIG. 1 there is shown a fluorescent lamp holder/assembly generally designated 10. Fluorescent lamp holder 10 includes a fluorescent tube or lamp 12 that is radially surrounded by a protective sleeve, tube or cylinder 14 that is preferably made of a light-transmissive plastic. Fluorescent lamp 12 and sleeve 14 are received at one end thereof in end cap 16. The other end of fluorescent lamp 12 and sleeve 14 are received in tube power connector cap 18 which is coupled to power attachment cap 20. Sleeve 14 and power connector cap 18 are glued together and water-tight. Electrical power is provided to fluorescent lamp holder 10 via power cord 22 coupled to power attachment cap 20, wherein power cord 22 is wired to or in communication with a source 23 of electrical power (shown schematically in FIG. 1). Attachment clip 28, preferably of metal, is used to retain power attachment cap 20 to power connector cap 18.

As shown in FIG. 1*a*, fluorescent lamp 12 has two sets 13*a* and 13*b* of conventional electrical leads, terminals, prongs or the like, one set on either end thereof for attachment to appropriate electrical leads or wires supplying the necessary electrical power.

With reference to FIGS. 2 and 3, there is shown sleeve 14 in greater detail. Sleeve 14 is defined by an elongated tubular wall 24 having a longitudinally disposed thick portion 26 along the elongated length of sleeve 14. Bore or shaft 25 is disposed in thick portion 26 and thus extends the entire elongated length of sleeve 14. As shown in FIG. 3, bore or shaft 25 has an electrical leads 25*a* and 25*b* running therethrough to provide an electrical connection between end cap 16 and power connector cap 18. Tubular wall 24 defines an inner cavity or hollow 27 in which fluorescent lamp 12 is received.

FIG. 4 depicts attachment clip 28 which is defined by an arcuate or semi-circular portion 29 having radially inward flange 30 on one end thereof, and radially inward flange 31 on another end thereof, and may be used to secure the various caps to either style power connector cap 18. Flanges 30 and 31 are received in respective openings (see below) in the particular cap and engage power connector cap 18 for positive retention.

With reference to FIGS. 5 and 6, there is depicted power attachment cap 20 which is preferably injection-molded made from a suitable dielectric material such as plastic. Power attachment cap 20 is defined by a generally cylindrical body 34 having a radially outward notch 35 in a front portion thereof and end block 36. End block 36 defines inner surface 40 in which are disposed two power cable bores 37*a* and 37*b* as well as tube prong receptacles bores/tube power connection bores 38*a* and 38*b*. Power cable bores 37*a* and 37*b* and tube prong receptacles 38*a* and 38*b* are in communication with power cable 22 for supplying electrical power to fluorescent lamp 12. Power cable 22 includes power cable leads 22*a* and 22*b*, shown schematically. Power cable leads 22*a* and 22*b* are electrically coupled to power cable bores 37*a* and 37*b*, respectively, as well as tube prong receptacle bores 38*a* and 38*b*, respectively. Opening 42 is disposed in body 34 which along with a diametrically opposite opening (not shown) allow the use of attachment clip 28.

In accordance with the present invention, sleeve 14 and power attachment cap 20 are generic with respect to the various achievable embodiments of fluorescent lamp holder 10.

With reference now to FIGS. 7–10 there is depicted end cap 16*a* and tube power connector cap 18*a* which, along with sleeve 14 and lamp 12, provide a disposable embodiment of fluorescent lamp holder 10. In particular, FIGS. 7 and 8 depict end cap 16*a*. End cap 16*a* is defined by tubular shell 44 having end portion 45, preferably injection-molded made from a dielectric plastic, and is sized to receive an end portion of sleeve 14 and fluorescent lamp 12 within opening 46. Electrical leads leads 25*a* and 25*b* that extend through bore 25 of sleeve 14 are attached to the fluorescent lamp terminals that are covered by end cap 16*a*, such as with push-on type socket terminals which are slid over the male lamp terminals. Preferably, end cap 16*a* is permanently attached to sleeve 14 via glue, sonic welding, or the like. FIGS. 9 and 10 depict tube power connector cap 18*a*, preferably made from a dielectric plastic, which is defined by cylindrical shell 48 having end wall 49. Tube power connector cap 18*a* has internal cavity 60 sized and dimensioned to receive fluorescent lamp 12 and sleeve 14 therein. End wall 49 includes two fluorescent lamp prong/terminal bores 50 and 51 through which the prongs/terminals 13*a* and 13*b* of the appropriate fluorescent lamp extend. Adjacent end wall 49 is radial ledge 52 which defines a front surface 53 that provides a stop for the sleeve 14 when sleeve 14 is received therein. Ledge 52 is sized to allow the fluorescent lamp terminals/prongs 13*a* or 13*b* to sufficiently extend through bores 50 and 51 such that the fluorescent lamp terminals/prongs 13*a* or 13*b* are receivable into bores 38*a* and 38*b* of power attachment cap 20 when assembled. Tube power connector cap 18*a* further includes electrical terminal bores 54 and 55 that allow the electrical leads 25*a* and 25*b* emanating from power attachment cap 20 to extend therein and feed through shaft 25 of sleeve 14 to couple with the fluorescent lamp terminals/prongs 13*a* or 13*b* disposed within end cap 16*a*. Preferably, tube power connector cap 18*a* is permanently attached as by glue, sonic weld, or the like to sleeve 14 and when assembled, abuts power attachment cap 20. In this regard, tube power connector cap 18*a* has radially outward notch 58 that provides alignment and abuts inside notch 35 of power attachment cap 20. Additionally, O-ring 56 is provided for sealing as power attachment cap 20 extends over and around tube power connector cap 18*a* via opening 43. Two openings, of which one opening 59 is shown, provides attachment points for attachment clip 28 if used.

As tube power connector 18*a* joins with power connector cap 20, the fluorescent lamp terminals 13*a* or 13*b* that extend through bores 50 and 51 of end wall 49 of tube power connector 18*a* are received in bores 38*a* and 38*b* of power attachment cap 20.

Thus, by using end cap 16*a* and tube power connector cap 18*a*, along with sleeve 14 and power attachment cap 20, a disposable fluorescent lamp holder is produced. Of course, it should be understood that fluorescent lamp 12 would be inserted into sleeve 14 and the appropriate end caps before securing same.

With reference now to FIGS. 11–14, there is depicted end cap 16*b* and tube power connector cap 18*b* which, along with sleeve 14 and power attachment cap 20, provide a replaceable lamp embodiment of fluorescent lamp holder 10. In particular, FIGS. 13 and 14 depict end cap 16*b*. End cap 16*b* is defined by tubular shell 62 having end portion/block 64 and is sized to receive an end portion of sleeve 14 and fluorescent lamp 12 within opening 65. End cap 16*b* is overmolded using an injection molding process over terminals disposed within bores 66 and 67. Fluorescent lamp terminal/prong bores 66 and 67 are disposed in block 63 from front surface 64. Additionally, electrical lead bores 68 and 69 are disposed in block 63 from front surface 64 and are in communication with fluorescent lamp terminal/prong bores 66 and 67 by lateral bores 70 and 71 respectively. This allows the electrical leads 25*a* and 25*b* extending through bore 25 of sleeve 14 to be electrically connected to the fluorescent lamp terminals/prongs 13*a* or 13*b* that are received in fluorescent lamp terminal/prong bores 66 and 67. Preferably, end cap 16*b* is permanently attached to sleeve 14 via glue, sonic welding, or the like. For replacement, the old fluorescent lamp is easily removed from end cap 16*b* which carries the terminal receptacles 66 and 67, while a new fluorescent lamp is easily installed into bores 66 and 67 of end cap 16*b* by pressure. Sleeve 14 remains attached to end cap 16*b*.

FIGS. 11 and 12 depict tube power connector cap 18*b*, preferably injection-molded made from a dielectric plastic, which is defined by cylindrical shell 74. Tube power connector cap 18*b* has internal cavity 82 sized and dimensioned to receive fluorescent lamp 12 and sleeve 14. Adjacent an end thereof is radial ledge 77 which defines a front surface 78 that provides a stop for sleeve 14. Tube power connector cap 18*b* further includes electrical terminal bores 79 and 80 that allow the electrical leads emanating from power attachment cap 20 to extend therein and feed through shaft 25 of sleeve 14 to couple with the fluorescent lamp terminals/prongs 13*a* or 13*b* disposed within end cap 16*b*. Preferably, tube power connector cap 18*b* is permanently attached as by glue, sonic weld, or the like to sleeve 14 and when assembled, aligns to abut in power attachment cap 20. In this regard, tube power connector cap 18*b* has radially outward notch 76 that provides alignment and abuts in notch 35 of power attachment cap 20. Additionally, O-ring 75 is provided for sealing as power attachment cap 20 extends over and around tube power connector cap 18*b* via opening 43. Two openings, of which one opening 81 is shown, provides attachment points for attachment clip 28 if used.

For replacement of an old fluorescent lamp carried within the replaceable embodiment of the present lamp holder 10, power attachment cap 20 is removed from tube power connector cap 18*b* which disengages the terminals/prongs of the old fluorescent lamp from bores 38*a* and 38*b*. The old fluorescent lamp that thus extends from tube power connector cap 18*b* is pulled therefrom also disengaging the other terminals/prongs 13*a* or 13*b* from bores 66 and 67 of end cap 16*b*. A new fluorescent lamp is inserted through tube power connector cap 18*b* such that one set 13*a* or 13*b* of terminals/prongs engage bores 66 and 67 in end cap 16*b*. Thereafter, power attachment cap 20 is engaged over tube power connector cap 18*b*.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A watertight fluorescent lamp holder assembly allowing replacement of a fluorescent lamp therein, the fluorescent lamp having a first set of terminals on one end thereof, and a second set of terminals on another end thereof, the fluorescent lamp holder assembly comprising:

a light-transmissive sleeve having a first end and a second end;

an end cap having a bore adapted to receive said first end of said sleeve, first and second terminal receptacles adapted to receive the first set of terminals of the fluorescent lamp received therein, and first and second electrical lead bores in communication with said first and second terminal receptacles of said end cap, respectively;

a connector cap having a bore adapted to receive said second end of said sleeve, and first and second electrical lead bores each extending from an outside surface of said connector cap to an internal point within said bore of said connector cap;

a power attachment cap having a bore therein adapted to be releasably received over a portion of said connector cap, first and second terminal receptacles of said power attachment cap adapted to receive the second set of terminals of the fluorescent lamp, and first and second electrical terminal bores, and a power cord adapted to be coupled to a source of electrical power and said first and second terminal receptacles of said power connector cap; and first and second electrical leads coupled to said power cord and extending respectively from said first and second electrical terminal bores of said power attachment cap through respective said first and second electrical lead bores of said connector cap, said sleeve, and respective said first and second electrical lead bores in said end cap;

wherein the fluorescent lamp is disposed with said sleeve and said connector cap, and the first set of terminals of the fluorescent lamp are releasably received in said first and second terminal receptacles of said end cap and the second set of terminals of the fluorescent lamp are releasably received in said first and second terminal receptacles of said power attachment cap.

2. The fluorescent lamp holder assembly of claim 1, wherein said caps are injection molded from a dielectric plastic.

3. The fluorescent lamp holder assembly of claim 1, wherein said end cap and said connector cap are permanently attached to said sleeve.

4. The fluorescent lamp holder assembly of claim 3, wherein said connector cap includes an O-ring disposed on an outside surface thereof along a portion receivable within said bore of said power attachment cap, and a radially outward notch, and said power attachment cap includes a radially outward notch adapted to align with said notch of said connector cap when said power attachment cap is received over said connector cap.

5. The fluorescent lamp holder assembly of claim 4, wherein said connector cap includes an annular ledge within said bore and defining a stop surface for an end of said sleeve.

6. A fluorescent lamp holder assembly kit for a fluorescent lamp having first and second sets of terminals, the kit comprising:

a light-transmissive cylinder having a first end and a second end;

a first hollow end cap adapted to receive a first end of said light transmissive cylinder;

a second end cap having first and second terminal receptacles therein adapted to be coupled to a source of electrical power;

a first connector cap having a bore adapted to receive said second end of said cylinder, first and second electrical lead bores each extending from an outside surface of said first connector cap to an internal point within said bore of said first connector cap, an annular ledge within said bore defining a front surface adapted to abut an end of said cylinder, and an end wall having first and second terminal bores therethrough;

a second connector cap having a bore adapted to receive said second end of said cylinder, and first and second electrical lead bores each extending from an outside surface of said second connector cap to an internal point within said bore of said second connector cap;

a power attachment cap having a bore therein adapted to be releasably received over a portion of one of said first and second connector caps, first and second terminal receptacles adapted to receive a second set of terminals of the fluorescent lamp, and first and second electrical terminal bores, and a power cord adapted to be coupled to a source of electrical power and said first and second terminal receptacles of said power attachment cap; and first and second electrical leads adapted to be coupled to said power cord and to extend respectively from said first and second electrical terminal bores of said power attachment cap through respective said first and second electrical lead bores of one of said first and second connector caps, said sleeve, and respective said first and second electrical lead bores in said end cap;

wherein one of said first and second end caps and one of said first and second tube connector caps are receivable on said cylinder to define one of a disposable or a replaceable lamp holder assembly; and wherein the fluorescent lamp is disposed with said cylinder and one of said connector caps, and the first set of terminals of the fluorescent lamp are receivable in one of said first and second end caps and the second set of terminals of the fluorescent lamp are releasably received in said first and second terminal receptacles of said power attachment cap.

7. The fluorescent lamp holder assembly kit of claim 6, wherein said first and second connector caps each includes an O-ring disposed on an outside surface thereof along a portion receivable within said bore of said power attachment cap, and a radially outward notch, and said power attachment cap includes a radially outward notch adapted to align with and abut to one of said notches of said connector caps when said power attachment cap is received over one of said connector caps.

8. The fluorescent lamp holder assembly kit of claim 6, wherein said caps are injection molded from a dielectric plastic.

9. The fluorescent lamp holder assembly of claim 6, wherein a chosen one of said end caps and a chosen one of said connector caps are permanently attached to said cylinder.

* * * * *